US006668599B2

(12) United States Patent
Nakada

(10) Patent No.: US 6,668,599 B2
(45) Date of Patent: Dec. 30, 2003

(54) WASHING MACHINE

(76) Inventor: Kazuo Nakada, 318, Hazawa-cho, Kanagawa-ku, Yokohama-shi, Kanagawa-ken (JP)

( * ) Notice: Subject to any disclaimer, the term of this patent is extended or adjusted under 35 U.S.C. 154(b) by 161 days.

(21) Appl. No.: 10/081,325

(22) Filed: Feb. 22, 2002

(65) Prior Publication Data

US 2002/0116960 A1 Aug. 29, 2002

(30) Foreign Application Priority Data

Feb. 26, 2001 (JP) ..... 2001-050284

(51) Int. Cl.[7] ..... D06F 39/10

(52) U.S. Cl. ..... 68/12.14; 68/18 F; 68/23.3; 68/13 R

(58) Field of Search ..... 68/12.01, 13 R, 68/19.1, 19.2, 23 R, 23.3, 23.4, 24, 18 F, 12.14

(56) References Cited

U.S. PATENT DOCUMENTS 2,498,420 A * 2/1950 Hemmeter
2,771,766 A * 11/1956 Dunlap
2,867,106 A * 1/1959 Stone, Jr. et al.
2,867,107 A * 1/1959 Brown
2,976,712 A * 3/1961 Smith
3,194,398 A * 7/1965 Fecho
3,306,082 A * 2/1967 Hasegawa et al.
3,957,649 A * 5/1976 Hine
4,240,913 A * 12/1980 Burke
4,809,524 A * 3/1989 Sickert et al.
5,318,705 A * 6/1994 Pellerin
6,401,362 B1 * 6/2002 Schultz et al.

FOREIGN PATENT DOCUMENTS

JP 5-146597 * 6/1993

OTHER PUBLICATIONS

European Patent Office 104,141 Aug. 1983.*
European Patent Office 796,842 Aug. 1997.*

* cited by examiner

*Primary Examiner*—Frankie L. Stinson
(74) *Attorney, Agent, or Firm*—Carella Byrne Bain Gilfillan Cecchi et al.; Eliot M. Olstein; William Squire

(57) ABSTRACT

The objective of the present invention is to provide a washing machine capable of removing earth/sand, waste thread, dust and the like stuck to the washing. In order to realize the objective, the washing machine is constituted so as to be operated as follows: overflowed washing water or rinsing water from washing/dehydrating tank to an annular drainage pipe by reciprocating revolutions of the tank is led to a side pipe, where the water is filtered and circulated to the tank by a pump arranged in the middle of the side pipe for utilizing the washing or the rinsing operation.

2 Claims, 6 Drawing Sheets

1 :washing/dehydrating tank
1a :drainage opening
1b :drainage plate
1c :convex columns
2 :cylindrical revolving axis
3 :bearing
4 :outer case
5 :pulley
6 :cover
6a :drainage orifices
7 :annular drainage pipe
7a :annular opening
7b :bottom
8 :side pipe
9 :loosiners
10 :revolving axis
17 :dehumidifier
18 :three-way branched pipe
18a :first branched pipe
18b :second branched pipe
18c :third branched pipe
19 :three-way valve
20 :cover
21 :filter
22 :holder
22a :slits
22b :flange
P :pump
F :filter apparatus
$S_1$ :pressure sensor
$S_2$ :pressure sensor

FIG. 1

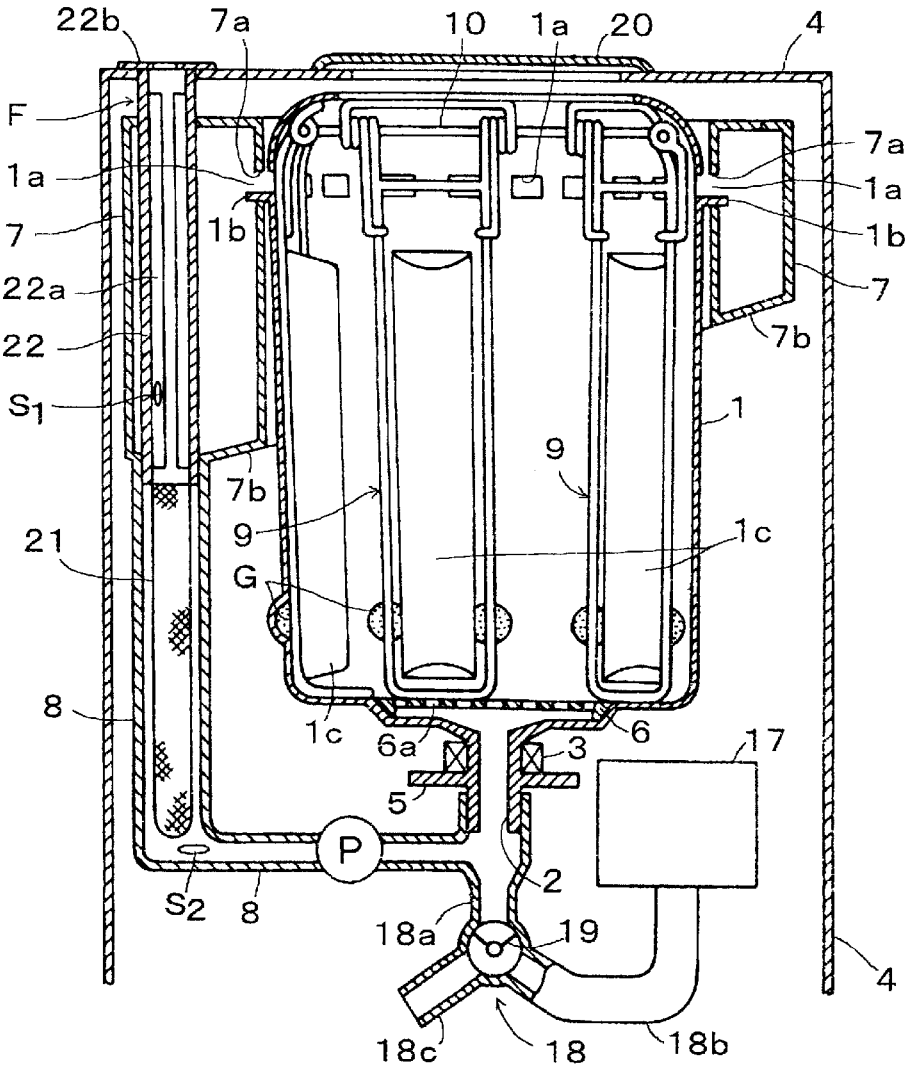

1 :washing/dehydrating tank
1a :drainage opening
1b :drainage plate
1c :convex columns
2 :cylindrical revoiving axis
3 :bearing
4 :outer case
5 :pulley
6 :cover
6a :drainage orifices
7 :annular drainage pipe
7a :annular opening
7b :bottom
8 :side pipe
9 :loosners
10 :revolving axis
17 :dehumidifier
18 :three-way branched pipe
18a :first branched pipe
18b :second branched pipe
18c :third branched pipe
19 :three-way valve
20 :cover
21 :filter
22 :holder
22a :slits
22b :flange
P :pump
F :filter apparatus
$S_1$ :pressure sensor
$S_2$ :pressure sensor 1d :openings 12 :pushing rods 13 :roller 14 :arm 15 :geared motor 16 :stopper 22 :holder 10 :revolving axis 11 :spring 12 :pushing rod 13 :roller 14 :arm 21 :filter
22 :holder
22a :slits
22b :flange
22c :bottleneck portion
23 :pin
F :filter apparatus

WASHING MACHINE

BACKGROUND OF THE INVENTION

1. Field of the Invention

The present invention relates to a washing machine.

2. Brief Description of the Related Art

The applicant proposed a conventional washing machine in the Japanese laid open patent No. 11-137895. The disclosed conventional washing machine is illustrated in FIGS. 5 and 6.

In these figures, a reference numeral "31" is a washing/dehydrating tank with a bottom, which is fixed to a first hollow cylindrical revolving axis 32 mounted for rotation in a bearing such that the journal 32 communicates with the washing/dehydrating tank 31. A reference character "t" is protrusions formed on the inner wall of the washing/dehydrating tank 31. A pulsator 34 is fitted to a second revolving conduit journal 33 arranged so as to rotate within and extending through the first cylindrical journal 32. An annular drainage pipe 35 is co-axially arranged with the tank at the upper periphery of the washing/dehydrating tank 31. A reference character "35*a*" is an annular drainage opening connected to the annular drainage pipe 35.

A reference numeral "36", arranged on the inner wall of the washing/dehydrating tank 31 for being pushed toward the center of the washing/dehydrating tank 31, is loosners for loosening the washing in the dehydrating tank. These loosners, in the form of bent rod paddles, are contacted to the above-mentioned inner wall by springs. A reference character "g" is rubber cushions for relieving colliding impacts of the loosners 36 to the inner wall.

The loosners 36 are pushed toward the center of the washing/dehydrating tank 31 against forces from the springs, in accordance with pushing movements of pushing rods 37 driven by a movement of a roller 38. The roller is moved in accordance with a revolving movement of the washing/dehydrating tank 31 and it is arranged at a corner of the annular drainage pipe 35. Consequently, the loosners 36 revolve around axes 36*a* attached to the inner wall of the washing/dehydrating tank 31.

The annular drainage pipe 35 has the annular drainage opening 35*a* on its inner wall and a plurality of drainage openings 31*a* are arranged on the washing/dehydrating tank 31 at positions facing to the annular drainage opening 35*a*.

On the upper side of the second cylindrical revolving axis 33 an opening 33*a* communicating with the washing/dehydrating tank 31 is formed and to the lower side of the second cylindrical revolving axis, a three-way branched pipe 39 is co-axially and rotatably connected.

The three-way branched pipe 39 is capable of forming an air discharge passage for leading dehumidified air from a dehumidifier 41, forming a drainage passage for draining washing water from the washing/dehydrating tank 31 and forming a closed passage for stopping the washing water from flowing out of the washing/dehydrating tank 31 by diverting a diverting valve 40.

In the above-mentioned conventional washing machine, the loosners 36 are positioned at standby positions from pushed positions and the three-way valve 40 of the three-way branched pipe 39 is diverted so as to form the closed passage before starting a washing operation. Then water is supplied to the washing/dehydrating tank 31, a detergent is added, the washing is put into the tank and the pulsator 34 is revolved.

During a rinsing operation, the pulsator 34 is revolved as water is being supplied into the washing/dehydrating tank 31. Water in the washing/dehydrating tank 31 is discharged via the drainage openings 31*a* to the annular drainage pipe 35, wherefrom water is discharged to the outside via a drainage pipe 50.

During a dehydrating operation, the three-way valve 40 of the three-way branched pipe 39 is diverted so as to form the drainage passage, the pulsator 34 is stopped and the washing/dehydrating tank 31 is revolved at a higher rate. In this operation, water in the washing/dehydrating tank 31 and included in the washing is moved upward along a slanted inner wall of the washing/dehydrating tank 31 by a centrifugal force and is discharged into the annular drainage pipe 35 via the drainage openings 31*a* and also is discharged from the drainage passage. Washing/rinsing water stayed in the second annular axis 33 and the three-way branched pipe 39 during the washing/rinsing operations is discharged from the drainage passage.

When the dehydrating operation is finished, the washing in the washing/dehydrating tank 31 is moved to and annularly pressed against the inner wall of the tank, and an air passage is already formed during the dehydrating operation at the center portion of the washing.

After finishing the dehydrating operation, the loosners 36 are pushed toward the center of the washing/dehydrating tank 31 so as to loosen the stuck washing to the inner wall. Thus, air passages are formed among the washing and between the washing and the washing/dehydrating tank 31.

After the air discharge passage is secured by diverting the three-way valve 40 of the three-way branched pipe 39, a humidifier 41 is put into operation. Air bearing humidity in the outer case and in the washing/dehydrating tank 31 is sucked and dehumidified by the dehumidifier 41. The washing is dried by repeated cycles of the above-mentioned sucking and dehumidifying procedures. The drying operations and above-described loosening operations can be properly and repeatedly carried out.

However, there are still the following problems in the conventional washing machine.

The washing operation is carried out according to a sequence consisting of securing the closed passage by diverting the three-way valve 40 of the three-way branched pipe 39, supplying water, adding the detergent and putting the washing into the washing/dehydrating tank 31, consequently the washing is washed as earth/sand, waste thread, dust and the like are being stuck to the washing, when the washing bears the above-mentioned foreign substances.

Floating earth/sand, waste thread, dust and the like are removed to a certain extent when a large quantity of water is used, since overflowed water from the washing/dehydrating tank 31 is discharged to the annular drainage pipe 35 as water being supplied to the washing/dehydrating tank 31 and the pulsator 34 being revolved during the rinsing operation. However this rinsing operation is not enough to remove the above-mentioned foreign substances completely.

Consequently, the washing is dehumidified and dried without removing stuck earth/sand, waste thread, dust and the like to the washing completely. Remaining earth/sand, waste thread, dust and the like can be removed afterward, but a further troublesome work is required to remove them.

SUMMARY OF THE INVENTION

The present invention is carried out in view of the above-mentioned problems. The objective of the present invention is to provide a washing machine capable of removing stuck earth/sand, waste thread, dust and the like to the washing effectively by arranging the washing machine such that overflowed or rinsing water from a washing/dehydrating tank is led to a side pipe, where water is filtered and circulated to the washing/dehydrating tank by a pump arranged in middle of the side pipe when washing and rinsing operations are executed by revolving the washing/dehydrating tank.

The washing machine provided by the present invention comprises: a cylindrical washing/dehydrating tank with its diameter gradually increasing from its bottom to its upper portion, having a bottom fixed to a cylindrical revolving journal arranged as a communicating pipe being communicated to the tank; an annular drainage pipe co-axially arranged with the tank at an upper periphery of the washing/dehydrating tank; loosners for loosening the washing attached to the inner wall of the tank so as to be pushed toward the center of the washing/dehydrating tank; a pushing means for pushing lossners toward the center of the washing/dehydrating tank; a dehumidifier; an annular opening formed on the inner wall portion of the annular drainage pipe; a plurality of drainage openings formed on the washing/dehydrating tank so as to face against the annular opening; a three-way branched pipe capable of forming an air supply passage for leading dried air from the dehumidifier to the washing/dehydrating tank, a drainage passage for discharging washing water from the washing/dehydrating tank to the outside or a closed passage for stopping washing water flowing out of the washing/dehydrating tank by diverting a three-way valve, co-axially and revolvingly connected to the lower portion of the cylindrical revolving journal; a side pipe arranged between the annular drainage pipe and the three-way branched pipe for circulating overflowed washing water from the washing/dehydrating tank to the annular drainage pipe via the three-way branched pipe to washing/dehydrating tank or for discharging washing water to the outside by a pump; and a demountable filter arranged in the side pipe.

Sensors for detecting the quantity of the overflowed washing water from the washing/dehydrating tank to the annular drainage pipe can be arranged in the side pipe and/or the annular drainage pipe so as to control revolution rates of the washing/dehydrating tank and the pump.

BRIEF DESCRIPTION OF DRAWINGS

FIG. 1 is a longitudinal sectional view of an embodiment of a washing machine.

DETAILED DESCRIPTION OF PREFERRED EMBODIMENTS

Hereinafter the embodiment according to the present invention is explained.

Figure 2:
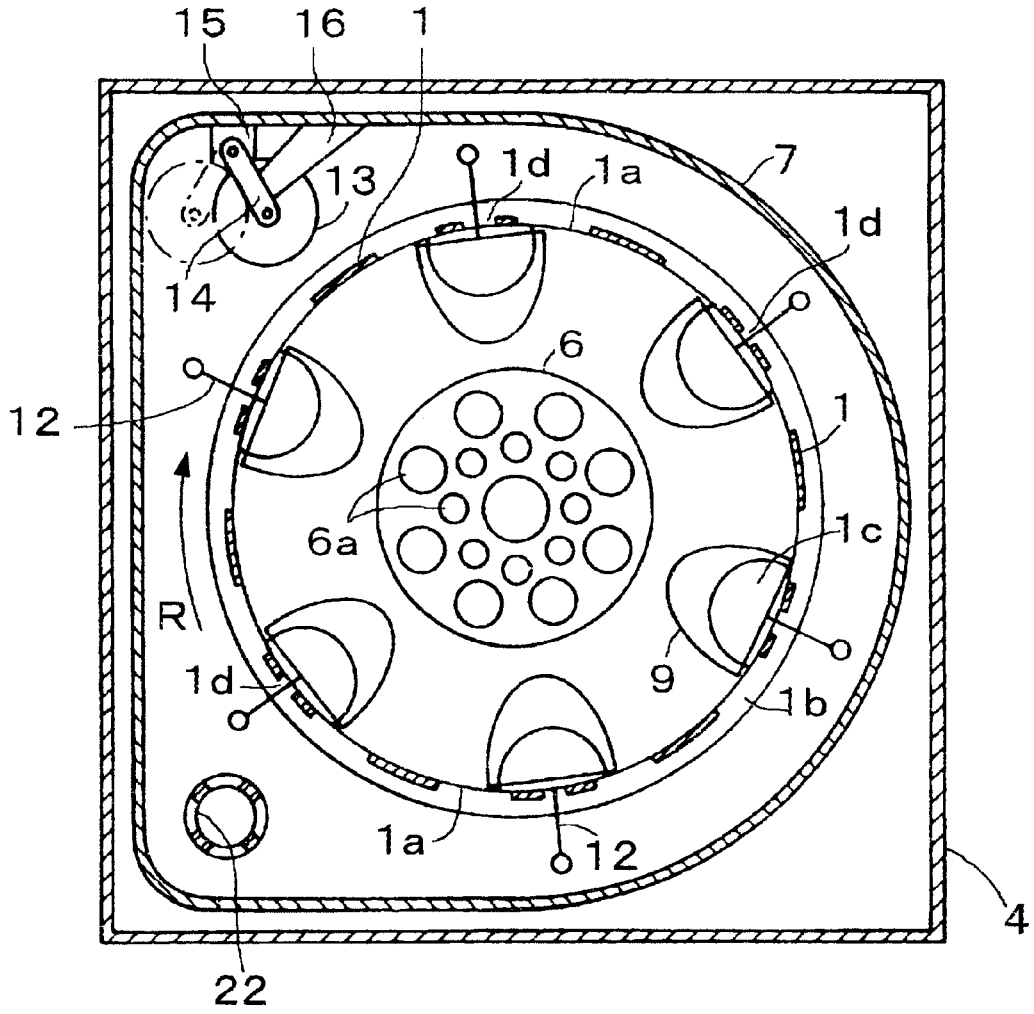
FIG. 2 is a cross sectional view of the washing machine sectioned at portion of a drainage pipe of a washing/dehydrating tank of the washing machine in FIG. 1.
Figure 3:
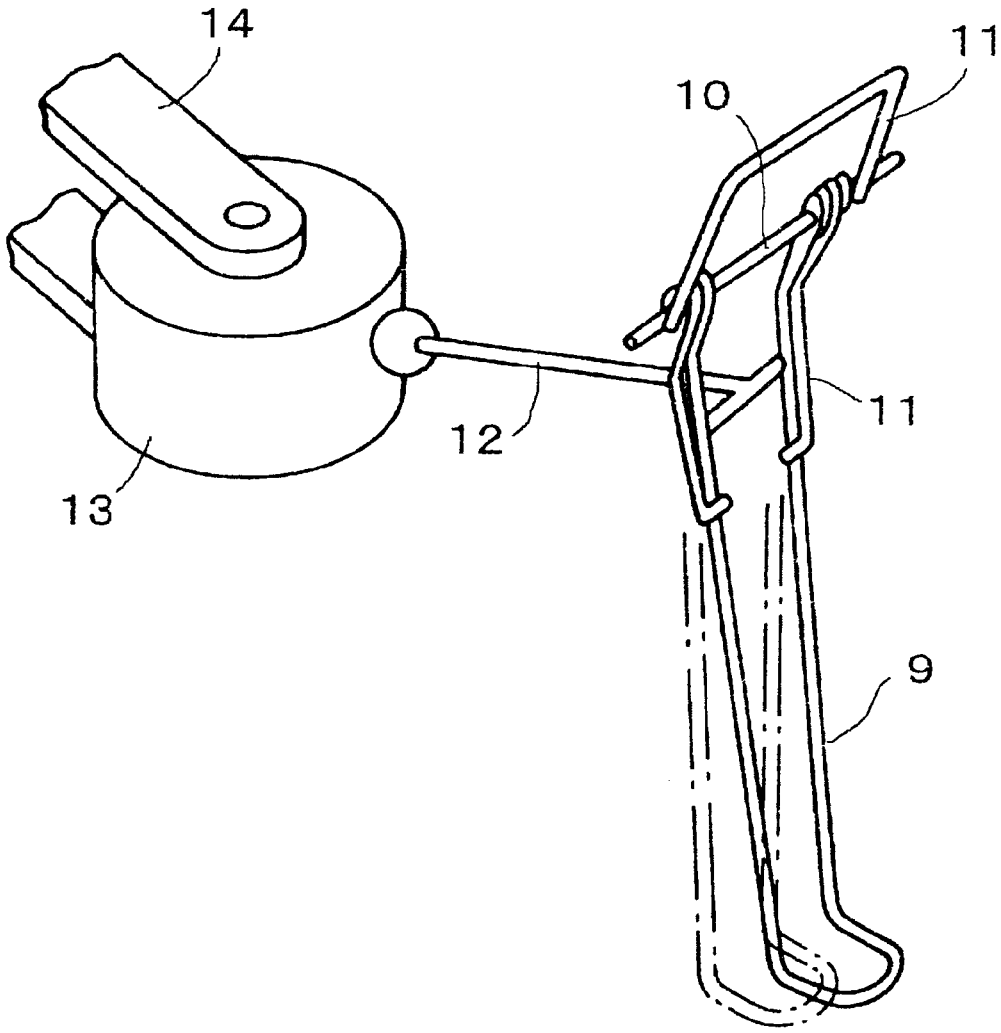
FIG. 3 is a partial view for explaining a movement of a loosner shown in FIG. 1.
Figure 4:
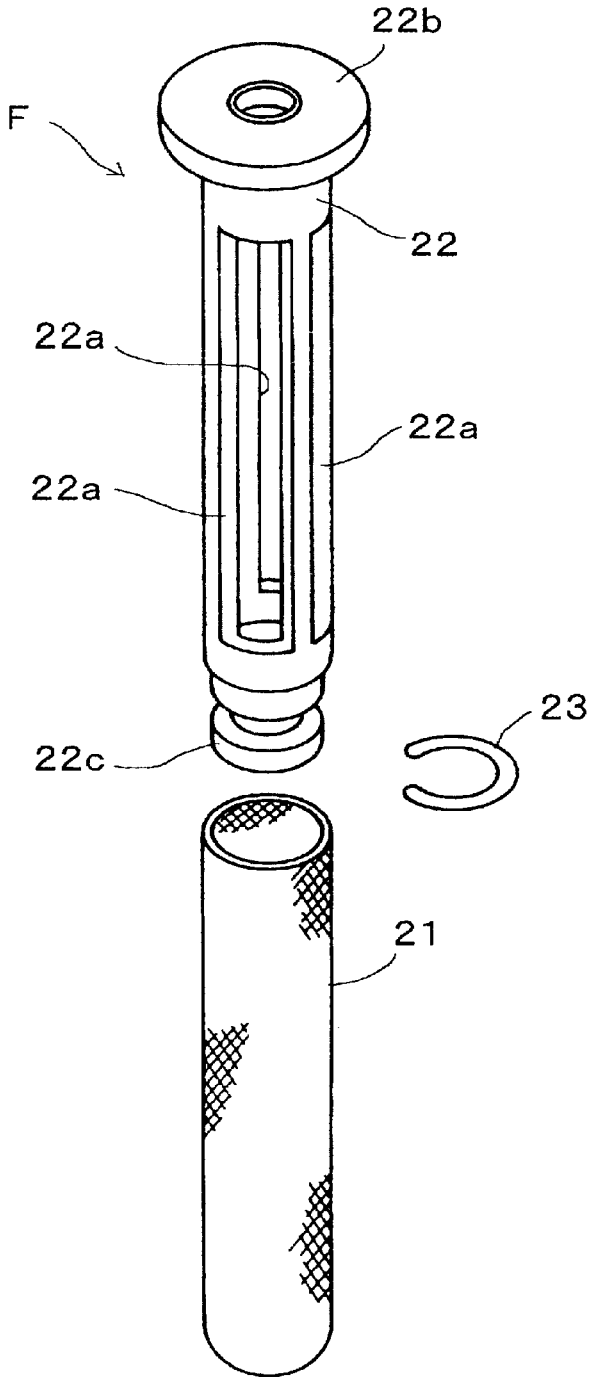
FIG. 4 is an exploded perspective view of a filter apparatus shown in FIG. 1.
Figure 5:
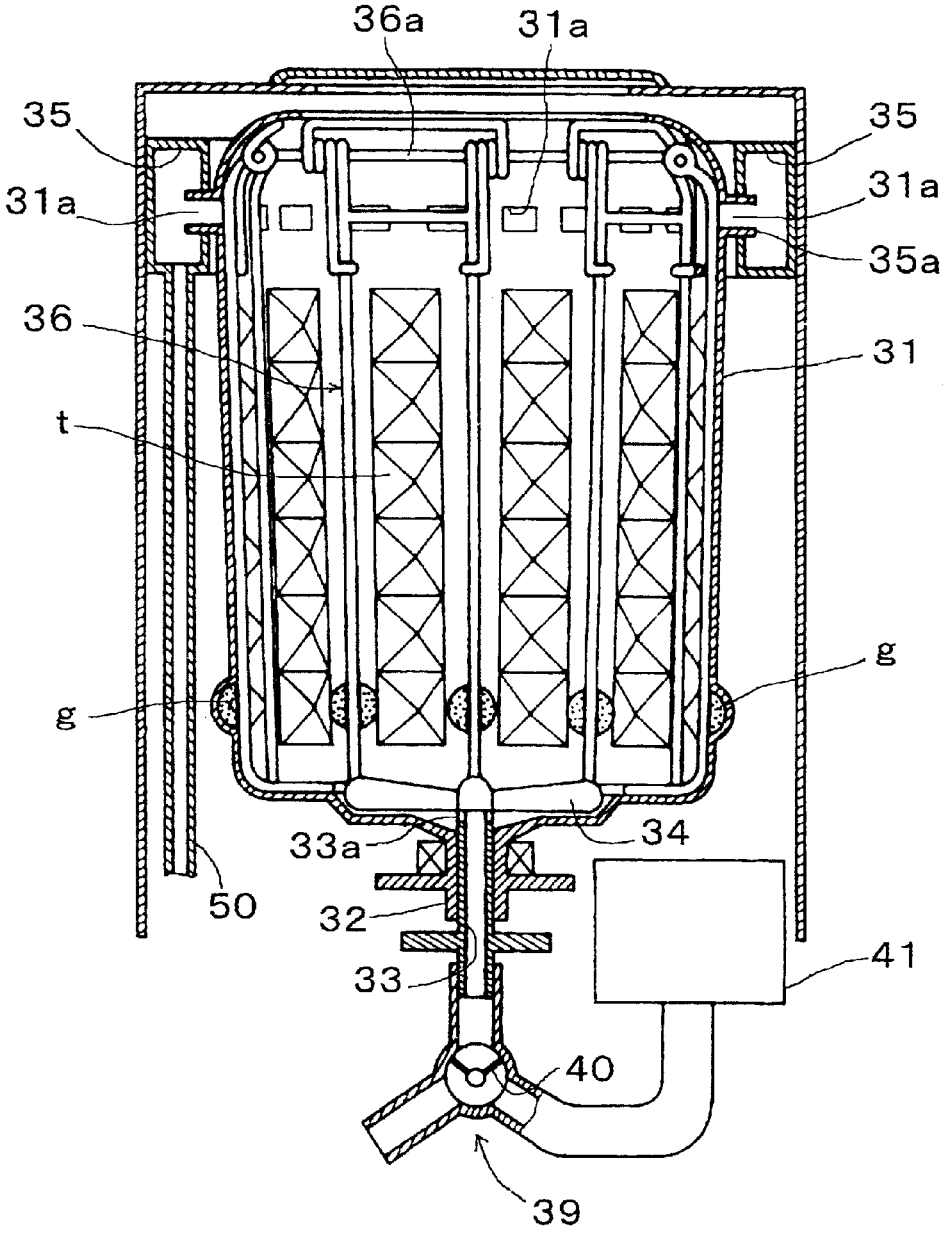
FIG. 5 (PRIOR ART)
FIG. 5 is a longitudinal sectional view of a conventional washing machine.
Figure 6:
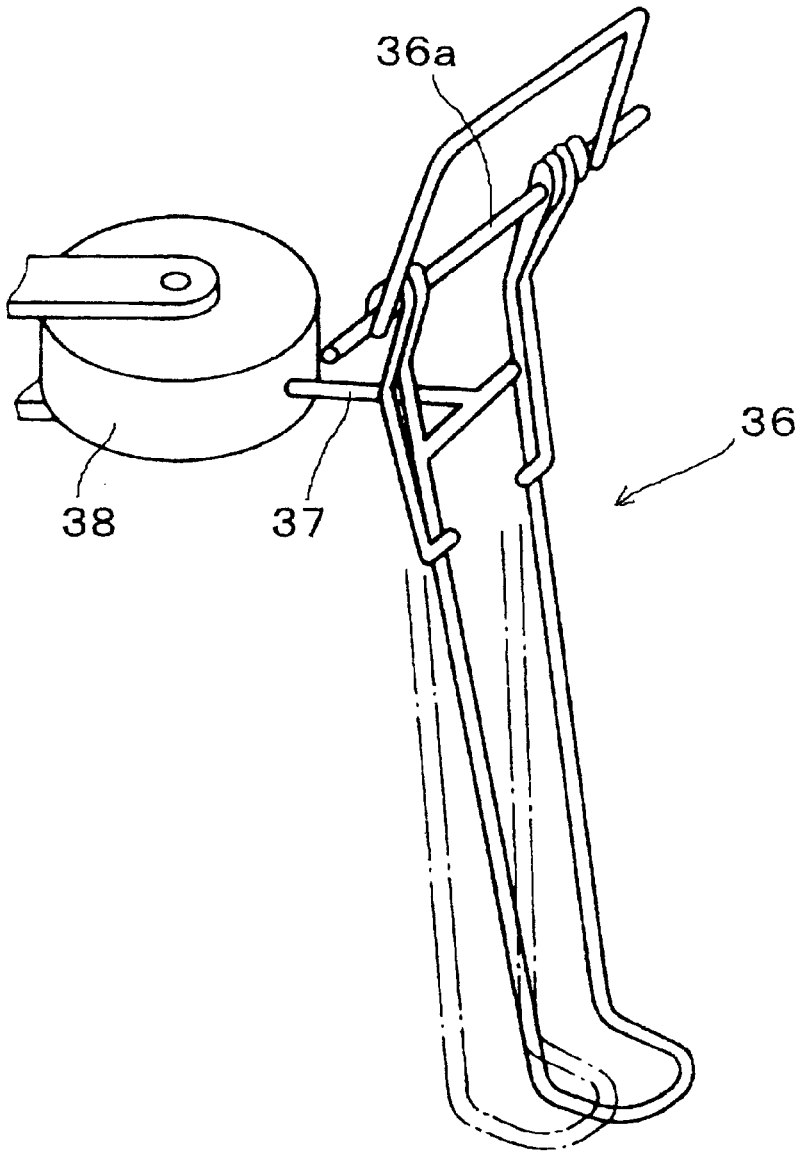
FIG. 6 (PRIOR ART)
FIG. 6 is a partial view for illustrating a loosner shown in FIG. 5.

FIG. 1 is the longitudinal sectional view of the embodiment of the washing machine. FIG. 2 is the cross sectional view of the washing machine in the embodiment. FIG. 3 is the partial view for explaining the movement of the loosner shown in FIG. 1. FIG. 4 is the exploded perspective view of the filter apparatus shown in FIG. 1.

In these figures, a reference numeral "1" is a washing/dehydrating tank with a bottom plate, having a diameter gradually increasing from its bottom to its upper portion. The washing/dehydrating tank 1 is fixed to a cylindrical revolving axis 2, which functions as a pipe led to the tank 1. The cylindrical axis 2 is attached to an outer case 4 via a bearing 3. The diameter at the upper portion of the washing/dehydrating tank 1 is required to set 5 to 10% larger than that of the bottom portion. In this embodiment it is 8% larger than that of the bottom portion. The washing/dehydrating tank 1 is forward or reciprocatingly revolved by a motor. A reference numeral "5" is a pulley for revolving the washing/dehydrating tank 1. The motor is set at a reciprocating mode during washing and rinsing operations. Operational modes of the washing machine is set by inputting keys (not shown).

A reference character "1*a*" is drainage openings formed with a predetermined pitch at the upper peripheral wall of the washing/dehydrating tank 1 and a reference character "1*b*" is a flange-shaped drainage plate formed at lower sides of the drainage openings 1*a*.

A reference numeral "6" is a cover for covering an opening portion of the cylindrical revolving journal 2 positioned at the bottom portion of the washing/dehydrating tank 1. A lot of small drainage orifices 6*a* are formed on the cover 6 as shown in FIG. 2.

A reference numeral "7" is an annular drainage pipe co-axially formed with the washing/dehydrating tank 1 around the upper periphery of the tank 1 and a reference character "7*a*" is an annular opening formed on the inner wall of the annular drainage pipe 7. A bottom plane 7*b* of the annular drainage pipe 7 forms an inclined plane inclined toward a side pipe 8, which is explained below. The above-mentioned drainage plate 1*b* is fitted in the annular opening 7*a*. The washing/dehydrating tank 1 and the annular drainage pipe 7 are arranged so as to attain the above-described fitting-in relation.

A reference numeral "8" is the side pipe linking the annular drainage pipe 7 with a three-way branched pipe 18, which will be explained below, for circulating washing water flowing from the washing/dehydrating tank 1 via drainage openings la and the annular opening 7*a* into the annular drainage pipe 7 to the washing/dehydrating tank 1.

A reference character "1*c*" is convex columns with a semicircular cross section arranged on the inner wall of the washing/dehydrating tank 1. Six convex columns 1*c* are circularly arranged with a 60 degree angled pitch.

Although it is not illustrated, a means for preventing the washing/dehydrating tank from vibrating is also arranged, when the washing is unevenly placed during the dehydrating operation.

A reference numeral "9" is loosners for loosening the washing after the dehydrating operation, which are attached to revolving axes 10 arranged on the inner wall of the washing/dehydrating tank in the vicinity of the openings via a bracket (not shown). The loosners 9 are formed so as to have a shape and a size such that the lossners 9 are arranged along the inner wall of the washing/dehydrating tank and do not interfere with the cover 6. More specifically, as shown in FIG. 3, the loosner 9 is formed out of a U-shaped rod, which is bent so as to be formed in an L-shape in its side view. Respective loosners 9 are arranged closely to respective convex columns 1*c* such that the loosner surrounds the convex column. Six loosners 9 are arranged circularly with a 60 degree angled pitch.

A reference numeral "11" is springs for pressing the loosners 9 against the inner wall of the washing/dehydrating tank 1 such that the loosners 9 are positioned at idle positions.

A reference numeral "12" is pushing rods protrudingly attached to the loosners 9. Each pushing rod 12 runs through a hole 1*d* (FIG. 2) arranged between two drainage openings 1*a* and protrudes into the annular drainage pipe 7. The pushing rods 12 are pushed toward the center of the washing/dehydrating tank 1 against the forces from the springs, when a roller 13 arranged at the corner portion of the pipe 7 is moved from an idle position to an operating position and is contacted with the pushing rods 12. A reference character "G" is rubber cushions, mated in concave portions formed on the washing/dehydrating tank 1, for relieving impacts when the loosners 9 return to idle positions by applied forces from springs 11.

As shown in FIG. 2, a reference numeral 13 is the roller arranged at the corner portion of the annular drainage pipe 7 for pushing loosners 9, when it strikes pushing rods. The roller 13 is attached to a geared motor 15 via an arm 14 such that the roller can be moved rotatingly on a horizontal plane, where a roller depicted by a chained line shows the idle position and a roller depicted by a solid line shows the operational position. A control means (not shown) controls positioning to both positions. A reference numeral "16" is a stopper for holding the arm 14 at the operational position.

Hereinafter relations between the roller 13 and loosners 9 and their functions are explained.

After the roller 13 is positioned at the operational position, the washing/dehydrating tank 1 is slowly revolved in an R direction illustrated in FIG. 2 so that the pushing rod 12 is contacted with and pushed by the roller 13. Respective loosners 9 are successively pushed into the center of the washing/dehydrating tank 1. The washing after dehydrating operation is loosened by the pushed loosners 9.

A reference numeral "17" is a humidifier and a reference numeral "18" is the three-way branched pipe arranged between the cylindrical revolving axis 2 and the humidifier 17. The three-way branched pipe 18 comprises a first branched pipe 18*a,* a second branched pipe 18*b* and a third branched pipe 18*c*. The first branched pipe 18*a* and the cylindrical revolving journal 2 are connected such that they can be relatively revolved each other. The second branched pipe 18*b* is connected to a dried air outlet (not shown) of the humidifier 17. The third branched pipe 18*c* is opened to the outside.

A reference numeral "19" is a three-way valve. When the three-way valve 19 is diverted to a position illustrated in a solid line in FIG. 1, the first branched pipe 18*a* forms a closed passage, which stops water flowing from the washing/dehydrating tank 1 and the side pipe 8. When the three-way valve 19 is revolved by 120 degrees in a right direction in FIG. 1, the first branched pipe 18*a* and the third branched pipe 18*c* are connected so that a drainage passage is formed. The three-way valve 19 is controlled by a valve control means (not shown). A reference numeral "20" is a cover of the washing machine, which covers an upper opening of the outer case 4.

The above-mentioned side pipe 8 is connected to the first branched pipe 18*a*. A reference character "P" is a pump arranged in the middle of the side pipe 8.

Overflowed water from the washing/dehydrating tank 1 to the annular drainage pipe 7 due to the centrifugal force caused by the reciprocating revolutions of the washing/dehydrating tank 1, is accelerated by the pump P and circulated to the washing/dehydrating tank 1 via the cylindrical revolving journal 2.

The quantity of overflowed water from the washing/dehydrating tank 1 by the centrifugal forces caused by the reciprocating revolutions of the tank 1 during the washing or rinsing operation is increased in accordance with an increased extent of a reciprocating revolution rate of the tank 1. Consequently, a revolution rate of the pump should be regulated in accordance with the revolution rate of the washing/dehydrating tank 1 in order to circulate the overflowed water from the washing/dehydrating tank 1 to the tank 1.

A pressure sensor $S_1$ in the annular drainage pipe 7 near the side pipe 8 and a pressure sensor $S_2$ in the side pipe 8 are arranged for regulating the overflowed water circulation. Both pressure sensors $S_1$ and $S_2$ detect the quantity of the overflowed washing or rinsing water from the washing/dehydrating tank 1 and transmit outputted signals to the first control means (not shown) for controlling the reciprocating revolution rate of the washing/dehydrating tank 1 and to the second control means (not shown) for controlling the revolution rate of the pump P.

The first and second control means, to which detected signals by sensors $S_1$ and $S_2$ are respectively inputted, respectively control the reciprocating revolution rate of the washing/dehydrating tank 1 and the revolution rate of the pump P.

The washing/dehydrating tank 1 is arranged so as to set the revolution rate at a desired rate.

A reference character "F" is a filter apparatus comprising a filter 21, a holder 22 for holding the filter and a pin 23 for securing the filter 21 to the holder 22 as shown in FIG. 4.

The holder 22 is formed as a cylindrical body having slits 22*a* with a 90 degree angled pitch on its side, a flange 22*b* formed on its upper portion and bottleneck portion 22*c* formed on its lower portion. The filter 21 is formed in a shape like a long test tube and its upper portion is mated to the bottleneck portion 22*c* of the holder 22 and secured by the pin 23 mated to the bottleneck portion so as not to be disconnected from the bottleneck 22*c*.

The filter apparatus F is inserted into and fitted in holes formed on the outer case 4 and the annular drainage pipe 7. In a fitted status, the filter 21 is inserted into the side pipe 8, the flange 22*b* of the holder 22 is secured to the outer case 4 and the lower portion of the holder is inserted into and held by the annular drainage pipe 7. Washing water flowing into the annular drainage pipe 7 flows into the filter 21 via slits 22*a* of the holder 22.

In the washing machine of the present embodiment arranged as mentioned above, the roller 13 is positioned at the idle position and the closed passage is formed by diverting the three-way valve 19 before starting the washing operation. Then the washing is put into the washing/dehydrating tank 1. The quantity of the washing is measured by a revolving inertia generated by a dummy revolution of the washing/dehydrating tank 1 before water is supplied. After required water and detergent is supplied to the tank the washing operation is started. A distance between a water level in the tank and drainage openings 1*a* is varied in accordance with the quantity of the supplied water. Consequently, in order to carry on the washing operation, the reciprocating revolution rate of the washing/dehydrating tank is fixed at a rate where the flowing quantity of the water into the annular drainage pipe reaches to a proper value, as the revolution rate being gradually increased.

The washing revolved by a revolving water stream is pushingly washed by convex columns 1*c* of the washing/dehydrating tank 1. Since the loosners 9 are arranged near the respective convex columns 1*c* as if they surround the respective convex columns 1*c*, these convex columns 1*c* prevent the washing from strong strikes against the loosners 9, thus the loosners are prevented from bending. As a result, stresses caused by reciprocating revolutions against supporting portions of the revolving axes 10 of the loosners 9 can be reduced. The overflowed water from drainage openings 1*a* of the washing/dehydrating tank 1 by the reciprocating revolutions of the tank 1 is led through the side pipe 8 and the first branched pipe 18*a* of the three-way branched pipe 18 and returned to the washing/dehydrating tank 1 by the pump P. Thus the washing water in the washing/dehydrating tank 1 is circulated. Earth/sand, waste thread, dust and the like floating on or being included in the washing water, are removed by the filter 21 when the washing water is circulated.

Before the rinsing operation, the three-way valve 19 is diverted so as to form the drainage passage for discharging contaminated water during the washing operation from the washing/dehydrating tank 1. After forming the closed passage by diverting the three-way valve 19 and supplying the rinsing water, the first rinsing operation is executed as the rinsing water is being circulated a predetermined times by reciprocatingly revolving the washing/dehydrating tank 1. In this operation earth/sand, waste thread, dust and the like floating on or being included in the rinsing water are also removed by the filter 21.

When the first rinsing operation is finished, the three-way valve 19 is diverted so as to form drainage passage and to discharge the rinsing water.

Succeeding rinsing operations are executed in the same way as the first rinsing operation. The dehydrating operation is executed when a predetermined times of rinsing operations are finished.

After finishing discharging the rinsing water, the dehydrating operation is executed by revolving the washing/dehydrating tank 1 at a high rate (for example 1,000 r.p.m.) as the drainage passage is being formed in the three-way branched pipe 18.

Water included in the washing is moved upward along the inclined inner wall of the washing/dehydrating tank 1 by the centrifugal force and flows into the annular drainage pipe 7 via drainage openings 1*a* and discharged to the outside via the side pipe 8. During the dehydrating operation, the washing in the washing/dehydrating tank 1 is annularly stuck to the inner wall of tank 1 and the loosners 9 by the centrifugal force so that an air passage is formed at the center of the washing.

In the drying operation of the washing, the cover 20 of the washing machine is put over the upper opening of the outer case 4, the roller 13 is forwarded to the operational position, the three-way valve 19 is diverted so as to form an air supplying passage, the washing/dehydrating tank 1 is occasionally revolved in R direction shown in FIG. 1 and the washing is loosened by the loosners 9. The humidifier 17 is operated as the washing is being loosened.

Humid air in the outer case 4 and in the washing/dehydrating tank 1 is sucked and dehumidified by the dehumidifier 17 during the drying operation. Dehumidified dried air is led thorough the air supplying passage and the cylindrical revolving axis 2 to the washing/dehydrating tank 1 and then passed through the air passages formed in the washing and between the washing and the tank 1. The dried air removes humidity in the washing and returns to the dehumidifier 17 after passing through the outer case 4. The washing is dried, when the above-described cycle is repeated.

As explained above, according to the present invention, the washing machine is arranged such that the overflowed washing or rinsing water from the washing/dehydrating tank to the annular drainage pipe by the reciprocating revolutions of the tank, is led to the side pipe where the water is filtered and is circulated to the tank by the pump arranged in the middle of the side pipe so as to be utilized for washing or rinsing water again. As a result, earth/sand, waste threads, dust and the like stuck to or included in the washing are effectively removed during the washing and the rinsing operations.

What is claimed is:

1. A washing machine comprising:

a cylindrical washing/dehydrating tank with its diameter gradually increasing from its bottom to its upper portion, having a bottom fixed to a cylindrical revolving journal arranged as a communicating pipe communicating to said tank;

an annular drainage pipe co-axially arranged with said tank at an upper periphery of said washing/dehydrating tank;

loosners for loosening the washing attached to the inner wall of said tank so as to be pushed toward the center of said washing/dehydrating tank;

a pushing means for pushing said loosners toward the center of said washing/dehydrating tank;

a dehumidifier;

an annular opening formed on the inner wall portion of said annular drainage pipe;

a plurality of drainage openings formed on said washing/dehydrating tank so as to face against said annular opening;

a three-way branched pipe capable of forming an air supply passage for leading dried air from said dehumidifier to said washing/dehydrating tank, a drainage passage for discharging washing water from said washing/dehydrating tank to the outside or a closed passage for stopping washing water flowing out of said washing/dehydrating tank by diverting a three-way valve, co-axially and revolvingly connected to the lower portion of said cylindrical revolving journal;

a side pipe arranged between said annular drainage pipe and said three-way branched pipe for circulating overflowed washing water from said washing/dehydrating tank to said annular drainage pipe via said three-way branched pipe to washing/dehydrating tank or for discharging washing water to the outside by a pump; and a demountable filter arranged in said side pipe.

2. The washing machine according to claim 1, wherein: sensors for detecting the quantity of the overflowed washing water from said washing/dehydrating tank to said annular drainage pipe, are arranged in said side pipe and/or said annular drainage pipe so as to control revolution rates of said washing/dehydrating tank and said pump.

* * * * *